US006589083B2

(12) United States Patent
Kobayashi et al.

(10) Patent No.: US 6,589,083 B2
(45) Date of Patent: Jul. 8, 2003

(54) CONNECTOR

(75) Inventors: Yutaka Kobayashi, Yokkaichi (JP); Hajime Kawase, Yokkaichi (JP); Ryotaro Ishikawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/095,666

(22) Filed: Mar. 11, 2002

(65) Prior Publication Data

US 2003/0045180 A1 Mar. 6, 2003

(30) Foreign Application Priority Data

Mar. 9, 2001 (JP) ..... 2001-066589
Mar. 9, 2001 (JP) ..... 2001-066590
Mar. 9, 2001 (JP) ..... 2001-067484

(51) Int. Cl.[7] ..... H01R 13/436
(52) U.S. Cl. ..... 439/752; 439/595
(58) Field of Search ..... 439/752, 595

(56) References Cited

U.S. PATENT DOCUMENTS 5,044,991 A 9/1991 Colleran et al.
5,122,080 A 6/1992 Hatagishi et al.
5,830,013 A 11/1998 Saito et al.
6,071,153 A * 6/2000 Fink et al. ..... 439/752

* cited by examiner

*Primary Examiner*—Gary Paumen
*Assistant Examiner*—James R. Harvey
(74) *Attorney, Agent, or Firm*—Gerald E. Hespos; Anthony J. Casella

(57) ABSTRACT

A connector housing (10) has cavities (23) and a retainer insertion hole (27) that crosses the cavities (23). A retainer (30) can be held at a partial or full locking position in the retainer insertion hole (27). The retainer (30) has pairs of resilient locks (33) and fixed locks (35) for the corresponding cavities (23). The resilient locks (33) project into the cavities (23) when the retainer (30) is at the partial locking position while the fixed locks (35) project into the cavities, (23) when the retainer (30) is at the full locking position. The resilient locks (33) are wider than the cavities (23) and hence continue engaging the terminal fittings (10) while the retainer (30) is moved from the partial locking position to the full locking position. Thus, the terminal fittings (10) are locked doubly by the fixed locks (33) and parts of the resilient locks (33) when the retainer (30) is at the full locking position.

19 Claims, 16 Drawing Sheets

CONNECTOR

BACKGROUND OF THE INVENTION

1. Field of the Invention

The invention relates to a connector with a retainer.

2. Description of the Related Art

A connector with a retainer is disclosed in U. S. Pat. No. 5,044,991 and is shown in FIGS. 20 and 21 herein. This known connector has terminal fittings 1 that are insertable into cavities 2 of a housing 3. A retainer insertion opening 4 extends into one side surface of the housing 3 and crosses the respective cavities 2. A retainer 5 is insertable into the retainer insertion opening 4 and includes an alternating array of resiliently deformable locks 6 and fixed locks 7.

The retainer 5 initially is held at a partial locking position, as shown in FIG. 20(A), with the resilient locks 6 facing the cavities 2. The resilient locks 6 deform in response to forces exerted by the terminal fittings 1, and hence enable the terminal fittings 1 to be inserted into the cavities 2. The resilient locks 6 then are restored resiliently to engage and lock the terminal fittings 1. The retainer 5 subsequently is pushed in the direction of the arrow X and into to a full locking position, as shown in FIG. 20(B). Thus, the fixed locks 7 face the cavities 2 to lock the properly inserted terminal fittings 1.

Resilient locks usually are formed in the cavities. However, the provision of the resilient locks on the retainer simplifies the internal construction of the cavities and facilitates the molding of small housings.

Clearances must be formed between the resilient locks 6 and the fixed locks 7 to enable deformation of the resilient locks 6. However, the terminal fittings 1 edges of the terminal fittings 1 may enter the clearances to hinder movement of the retainer 5 from the partial locking position to the full locking position. Further, only the fixed locks 7 lock the terminal fittings 1 when the retainer 5 is pushed to the full locking position. Thus, double locking is not realized, and locking forces tend to be low.

The fixed locks may be widened to enhance locking forces. However, wider locks increase the width of the retainer and enlarge the connector.

Furthermore, the locking edges of the resilient locks 6 project forward from the fixed locks 7 to prevent the fixed locks 7 from getting caught while the retainer 5 is moved from the partial locking position to the full locking position.

The terminal fittings 4' may need to be withdrawn from the cavities for maintenance. In such a case, the retainer 5 is pushed in the direction of arrow Y in FIG. 22(B) to the partial locking position shown in FIG. 22(A). The resilient lock 6 then is deformed by a jig to disengage from the terminal fitting 4' and to enable the terminal fitting 4' to be withdrawn. However, the locking edge of each resilient lock 6 projects forward as described above. Thus, the lateral edge of the corresponding terminal fitting 4' may catch one end 6A of the locking edge of the resilient lock 6 while the retainer is returned to the partial locking position. Thus, a return movement of the retainer 1 may be hindered. Further, the terminal fitting 4' may be rectangular, and another end 6B on the locking edge of the resilient lock 6 may fall inside the rectangular terminal fitting 4' and get caught.

The present invention was developed in view of the above problems and an object thereof is to ensure a smooth movement of a retainer, in particular without getting caught by terminal fittings, and without enlarging a connector but enhancing locking forces.

SUMMARY OF THE INVENTION

The invention is directed to a connector that comprises a housing formed with at least one cavity into which a corresponding number of terminal fittings are insertable. A retainer insertion opening is formed in a first side surface of the connector housing and crosses the respective cavities. A retainer is insertable into the retainer insertion opening and can be held at a partial locking position and at a full locking position. The retainer comprises first locks that are resiliently deformable to permit the insertion of the terminal fittings into the respective cavities when the retainer is in the partial locking position. The first locks then are restored resiliently and lockingly engage the properly inserted terminal fittings. The retainer further comprises second locks for locking the properly inserted terminal fittings when the retainer is at the full locking position. The first locks of the retainer continue to engage the corresponding terminal fittings while the retainer is being moved from the partial locking position to the full locking position and after the retainer is in the full locking position. Consequently, the retainer can be moved smoothly and securely to the full locking position while the terminal fittings are held at specified positions. Furthermore, double locking is achieved and locking forces are enhanced because both the first and second locks engage the terminal fittings when the retainer is in the full locking position.

Each first lock continues to engage only one corresponding terminal fitting while the retainer is moved from the partial locking position to the full locking position. Thus, the width of each lock can be small.

The first and second locks of the retainer are spaced apart in an offset direction that intersects the inserting direction of the retainer and that preferably is normal to the inserting direction of the retainer.

The first locks and the second locks are displaced in a nonoverlapping manner. Thus, the width of the second locks can be set independently of the first locks, or can be set substantially equal to the entire width of the female terminal fittings, thereby remarkably enhancing the locking forces. The first lock preferably is at least one and one half times wider than the portion of the cavity that corresponds to the retainer insertion opening.

The first lock and/or the second lock may comprise a guide for guiding insertion of the terminal fitting.

The first and second locks are displaced in forward and backward directions. Therefore, the second locks can be set substantially as wide as the terminal fittings independently of the width of the first locks and without changing a dimension of the retainer along its inserting direction. Additionally, the locking forces can be enhanced considerably. As a result, strong locking forces of the second locks can be achieved with a small connector.

The second locks may be fixed at positions spaced from the deformable sections of the corresponding first locks to obtain large locking forces.

The second locks may be coupled movably to deformable sections of the corresponding first locks.

The second locks overlap the deformable sections of the first locks and preferably partly overlap the first locks along the offset direction. Therefore, displacement of the first and second locks can be shorter and the retainer can be shorter in a direction normal to its inserting direction.

Slanted surfaces are formed at comers of locking edges of the first locks of the retainer for locking the terminal fittings. The slanted surfaces allow the terminal fittings to escape and guide the terminal fittings to the locking edges when the retainer is moved even if the locking edges are at positions to be caught by the terminal fittings. Thus, the first locks are prevented from getting caught by the terminal fittings and the retainer can be smoothly moved.

Each first lock of the retainer preferably is wider than the terminal fitting. Thus, the opposite lateral sides of the first locks are outside the opposite side surfaces of the respective terminal fitting when the retainer is at the partial locking position. However, only one lateral side of each first lock locks the terminal fitting within the width of the terminal fitting when the retainer is at the full locking position. The locking edge of each first lock preferably is slanted back from the second lateral side toward the first lateral side.

The corner at one lateral side of the locking edge of the first lock may catch the side surface of the terminal fitting from inside when the retainer is returned from the full locking position to the partial locking position. However, each locking edge is slanted back toward its one lateral side. Thus, the one lateral side is more backward and the side surface of the terminal fitting opposite from the side surface that might catch the first lock is guided by the slanted locking edge. Thus, the terminal fitting may escape forward and the comer at the one lateral side of the locking edge will not get caught.

Escaping slanted surfaces are formed at corners of locking edges of the second locks of the retainer for locking the terminal fittings. Thus, the corners of the locking edges of the second locking portions of the retainer are prevented from getting caught by the terminal fittings. The escaping slanted surfaces may be beveled.

The terminal fittings are locked doubly in the cavities by the first and second locks, when the retainer is in the full locking position.

These and other objects, features and advantages of the present invention will become more apparent upon reading of the following detailed description of preferred embodiments and accompanying drawings. It should be understood that even though embodiments are separately described, single features thereof may be combined to additional embodiments.

BRIEF DESCRIPTIONS OF THE DRAWINGS

DETAILED DESCRIPTION OF THE PREFERRED EMBODIMENTS

Figure 1:
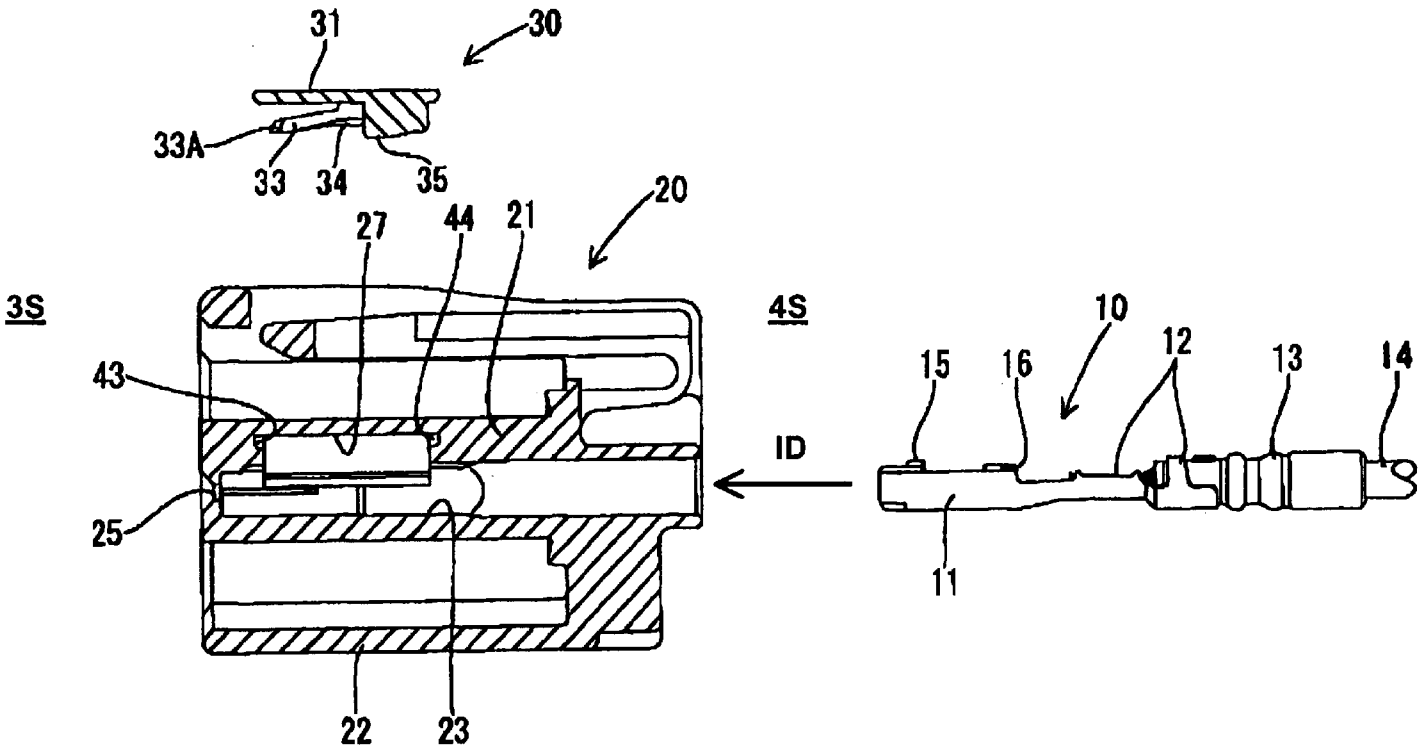
FIG. 1 is an exploded longitudinal section of a connector according to one embodiment of the invention.

A female connector in accordance with a first embodiment of the invention includes six female terminal fittings 10 accommodated in a housing 20, as shown in FIG. 1. Of course, more or fewer terminal fittings 10 may be provided The connector also includes a retainer 30 for locking the terminal fittings 10 in the housing 20.

Figure 2:
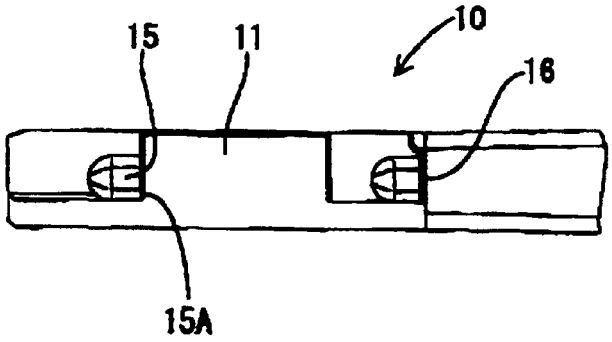
FIG. 2 is a fragmentary plan view of a female terminal fitting.
Figure 3:
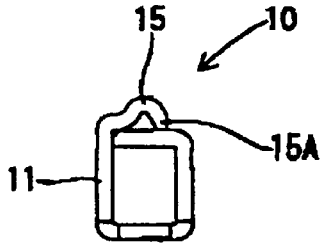
FIG. 3 is a front view of the female terminal fitting.

Each female terminal fitting 10 has opposite front and rear ends. A rectangular tubular connecting portion 11 is formed at the front end of each terminal fitting 10 and barrels 12 are formed at the rear end. A contact piece is disposed inside the connecting portion 11 for contacting the tab of a mating male terminal fitting (not shown). The barrels 12 are crimped into connection with both an end of a wire 14 and a rubber plug 13. Front and rear ends of the upper wall of the connecting portion 11 have a double-wall over more than half, and preferably over about ¾ of the width from one lateral edge, as shown in FIGS. 2 and 3. A rear end of the outer wall of the front double-wall structure is embossed outward to define an engaging projection 15 substantially in the width wise center of the connecting portion 11. Similarly, an engaging step 16 is formed at the rear end of the rear double-wall structure.

Figure 4:
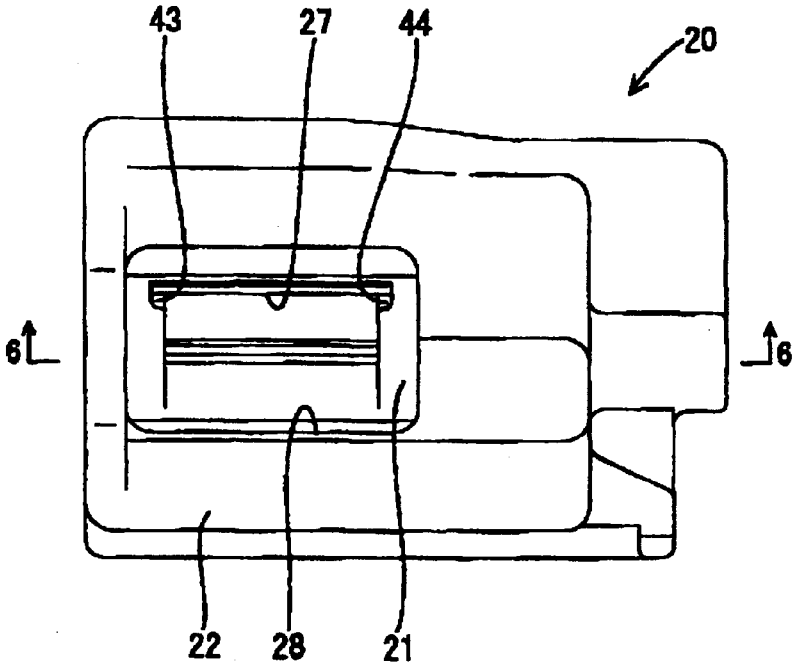
FIG. 4 is a side view of a female housing.
Figure 5:
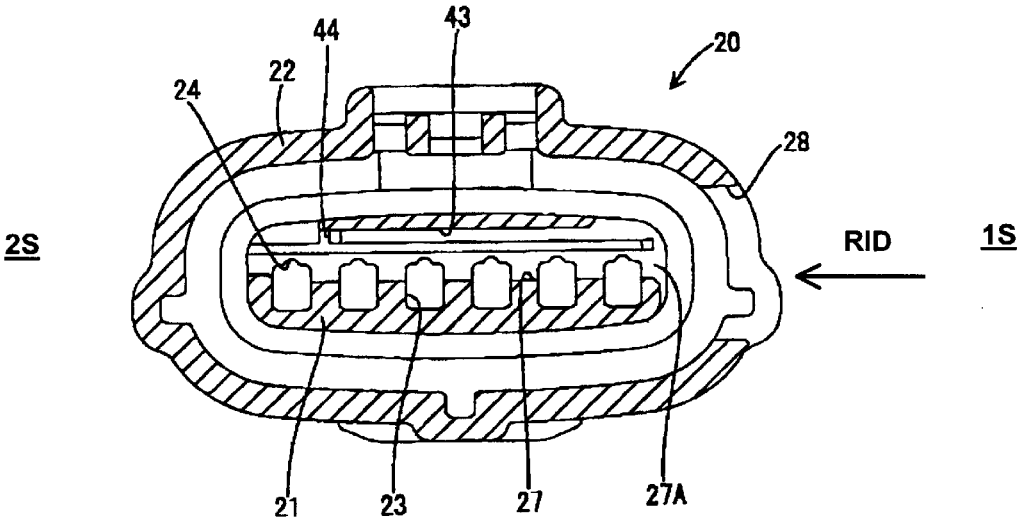
FIG. 5 is a lateral section of the female housing.
Figure 6:
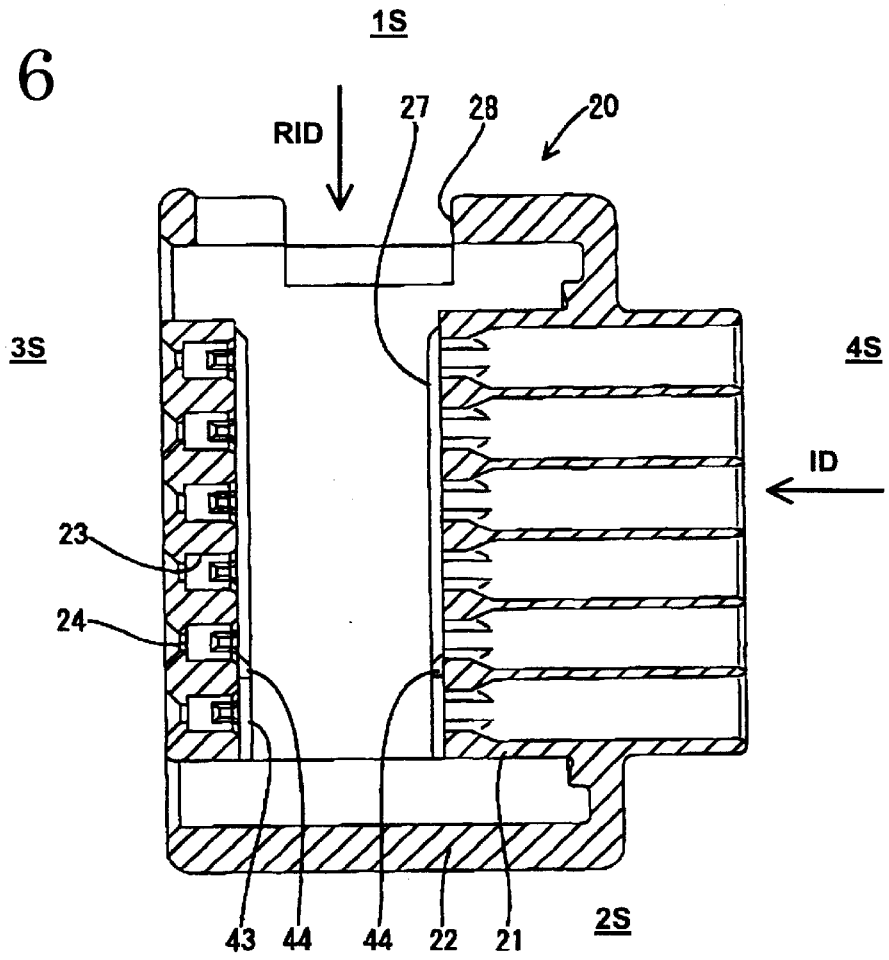
FIG. 6 is a section along 6—6 of FIG. 4.

The female housing 20 is made e.g. of a synthetic resin and includes a substantially flat tower 21, as shown in FIGS. 4 to 6. A receptacle 22 covers most of the front side of the tower 21. Six side-by-side cavities 23 extend longitudinally in forward and backward directions at specified intervals transversely across the tower 21. The terminal fittings 10 are insertable into the respective cavities 23 in an insertion direction ID from the rear end 4S, which is the right side in FIG. 1. A guide groove 24 is formed in the ceiling surface of each cavity 23 at the front end 3S of the housing 20. The guide groove 24 extends longitudinally in forward and backward directions to guide a sliding movement of the engaging projection 15 of the corresponding terminal fitting 10. A terminal insertion opening 25 is formed in the front wall of each cavity 23 to enable insertion of the tab of the mating male terminal fitting.

A retainer insertion opening 27 is formed near the front of the tower 21 and penetrates the tower 21 transversely to intersect upper portions of each cavity 23. The retainer insertion opening 27 has an entrance 27A on the right side 1S of the housing 20 when viewed from the front. An aperture 28 is formed in the right wall of the receptacle 22 and is slightly larger than the entrance 27A.

Figure 7:
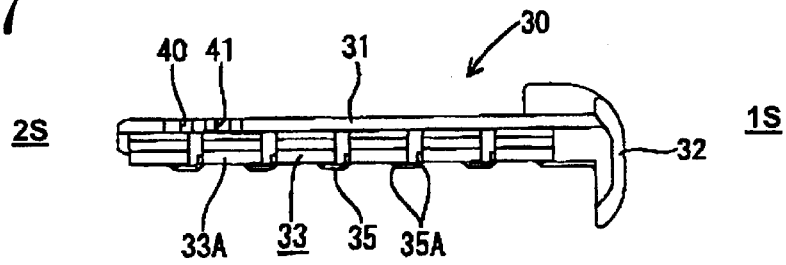
FIG. 7 is a front view of a retainer.
Figure 8:
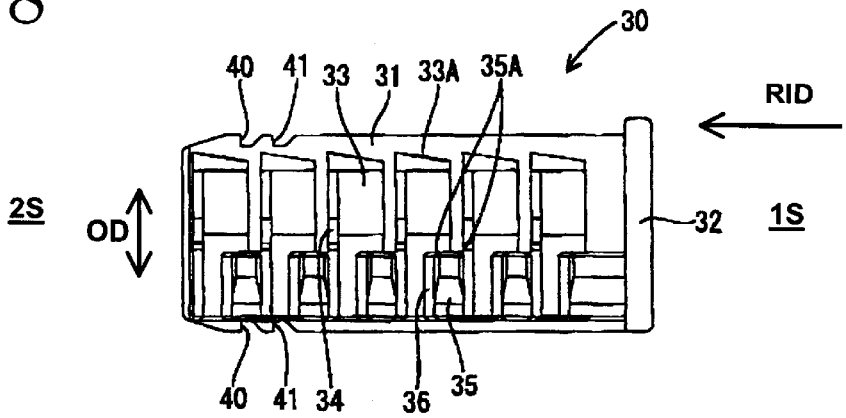
FIG. 8 is a bottom view of the retainer.

The retainer 30 is made e.g. of a synthetic resin and, as shown in FIGS. 7 and 8, has a main plate 31 that crosses the entire width of the tower 21. An operable portion 32 is formed at the rear end of the main plate 31 with respect to the inserting direction RID of the retainer 30. Pairs of resilient locks 33 and fixed locks 35 are formed on the lower surface of the main plate 31, and correspond in number with the number of the cavities 23.

Figure 10:
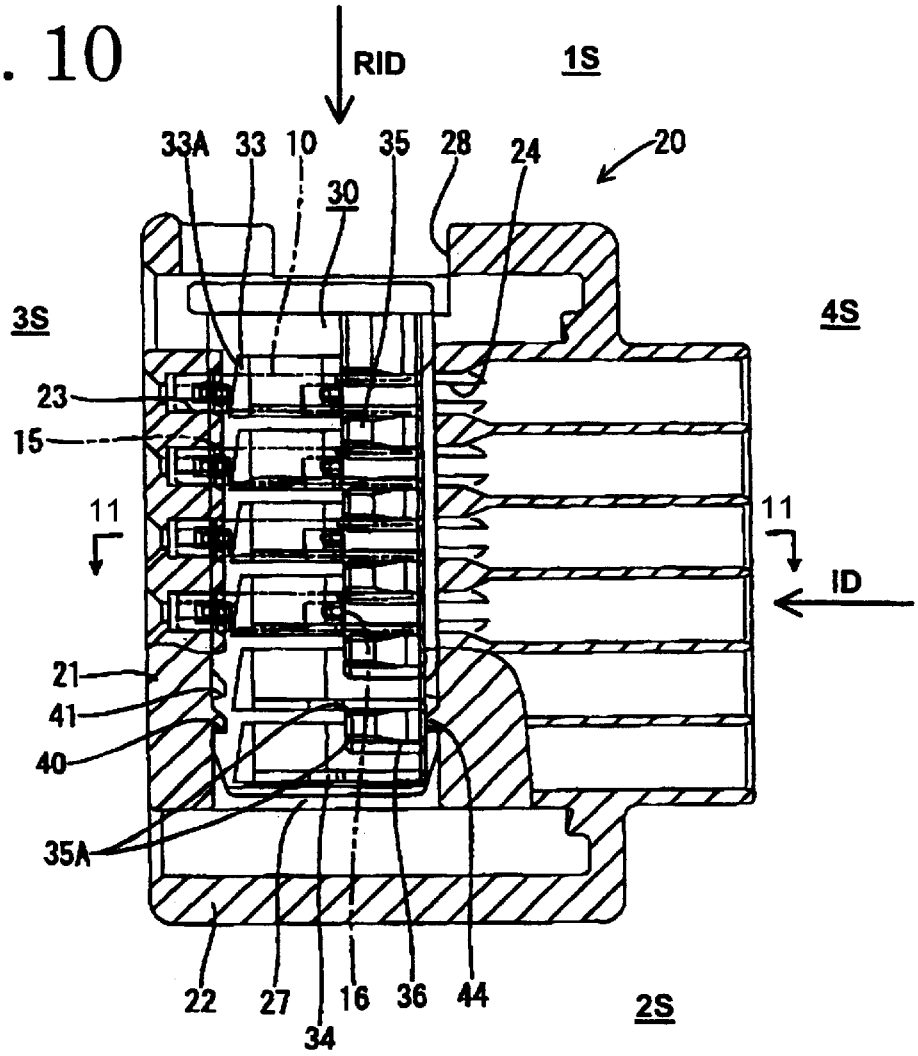
FIG. 10 is a section of the connector viewed from below when the retainer is located at the partial locking position.

The resilient locks 33 cantilever obliquely forward and down from middle positions on the lower surface of the main plate 31 with respect to the depth direction, and are configured for resiliently engaging the engaging projections 15 of the corresponding terminal fittings 10. Each resilient lock 33 is about 1.5 times the width of the front side of the cavity 23, as shown in FIG. 10. A free end of each resilient lock 33 is resiliently deformable up toward the main plate 31, and a left side of each resilient lock 33, when viewed from the front, has a slightly thicker base end that defines a guide wall 34.

Figure 13:
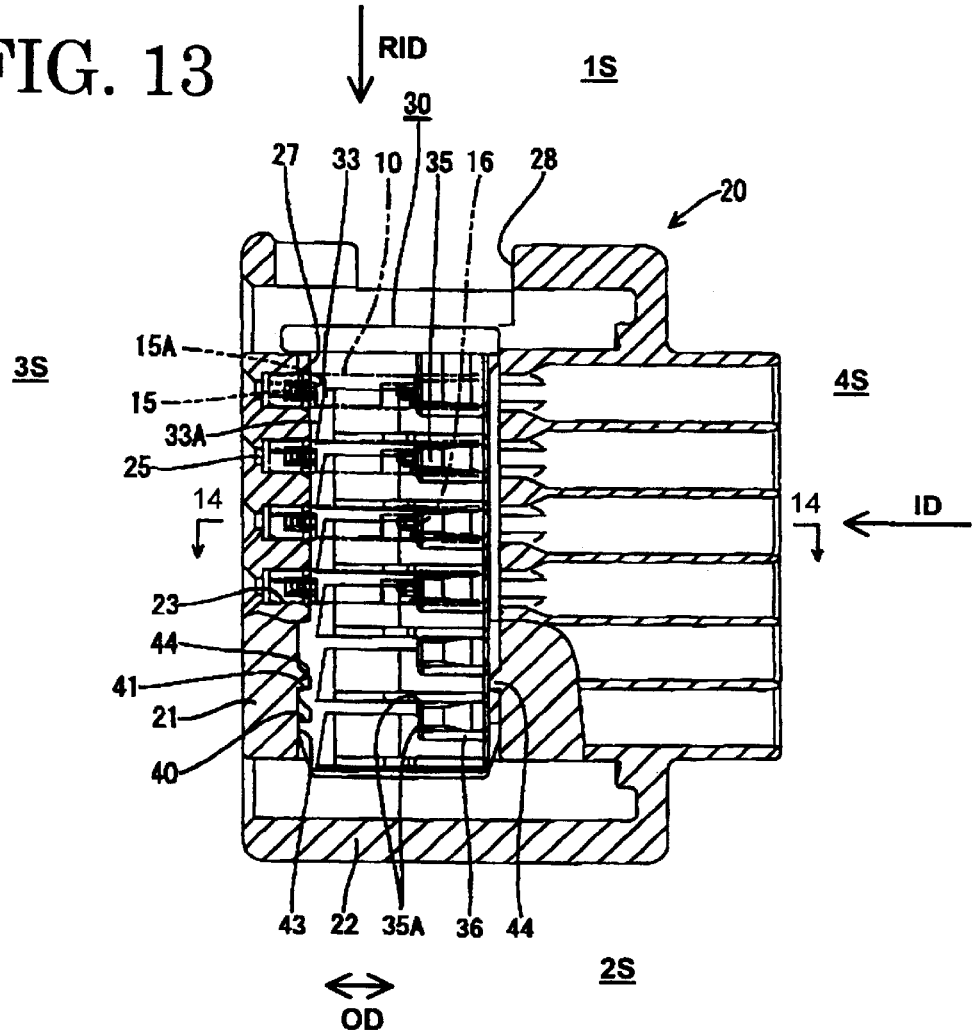
FIG. 13 is a section of the connector viewed from below when the retainer is located at the full locking position.
Figure 14:
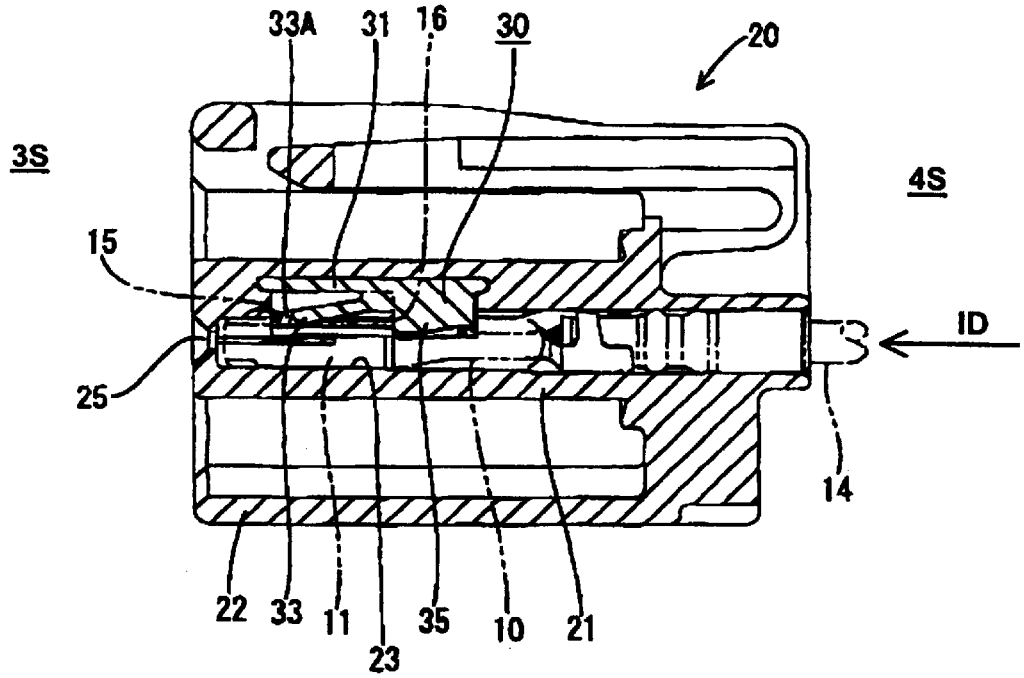
FIG. 14 is a section along 14—14 of FIG. 13.
Figure 15:
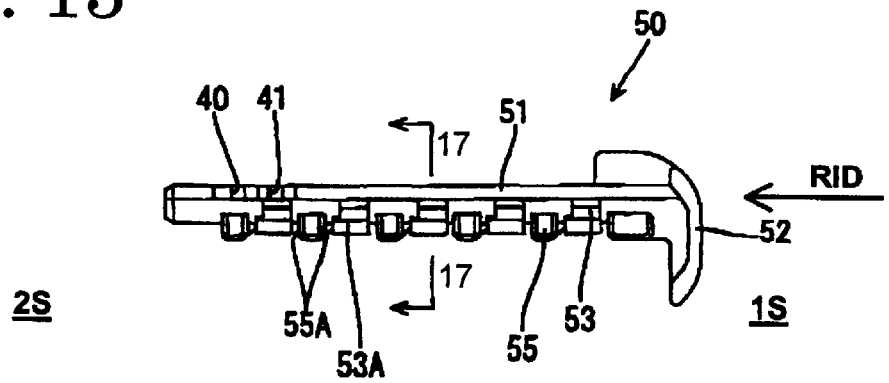
FIG. 15 is a front view of a retainer according to a second embodiment of the invention.
Figure 16:
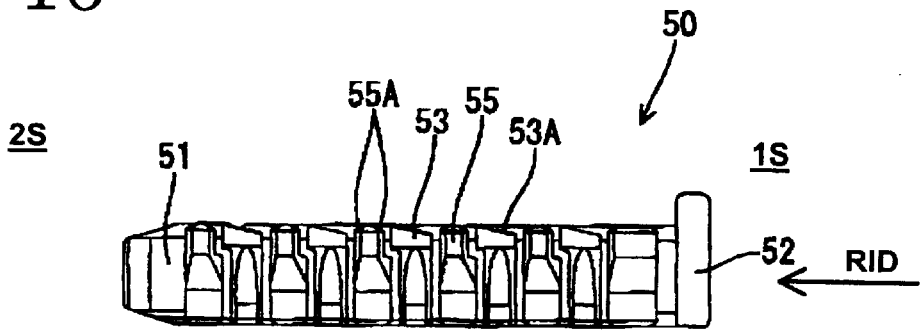
FIG. 16 is a bottom view of the retainer.
Figure 17:
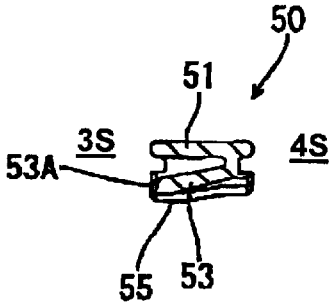
FIG. 17 is a section along 17—17 of FIG. 15.

The fixed locks 35 are at the back end of the lower surface of the main plate 31 and are displaced toward the right side 1S of the housing 20 by a specified distance from the corresponding pair of resilient locks 33, when viewed from the front. The fixed locks 35 are substantially as wide as the front side of the cavity 23, as shown in FIG. 13, and are configured for engaging the engaging step 16 of the corresponding terminal fitting 10. A guide 36 is recessed at the left side of the fixed lock 35, when viewed from the front.

Two partial locking recesses 40 and two full locking recesses 41 are formed substantially symmetrically at the front and rear edges of the end of the main plate 31 of the retainer 30 distant from the operable portion 32. Inserting grooves 43 are formed in the front and rear surfaces of an upper end of the retainer insertion opening 27 for receiving the front and rear edges of the main plate 31. Locking projections 44 are formed at the side of the inserting grooves 43 distant from the entrance 27A for individually engaging the partial locking recesses 40 and the full locking recesses 41.

The connector is assembled by first inserting the retainer 30 through the aperture 28 of the receptacle 22 and into the entrance of the retainer insertion opening 27 of the tower 21. The retainer 30 is advanced in the inserting direction RID until the partial locking recesses 40 engage the locking projections 44, as shown in FIG. 10. As a result, the retainer 30 is held temporarily at the partial locking position. At this stage, about ⅔ of the left-sides of the resilient locks 33 project into the corresponding cavities 23 and the fixed locks 35 are retracted toward the right side 1S from the corresponding cavities 23 when viewed from the front.

Figure 9:
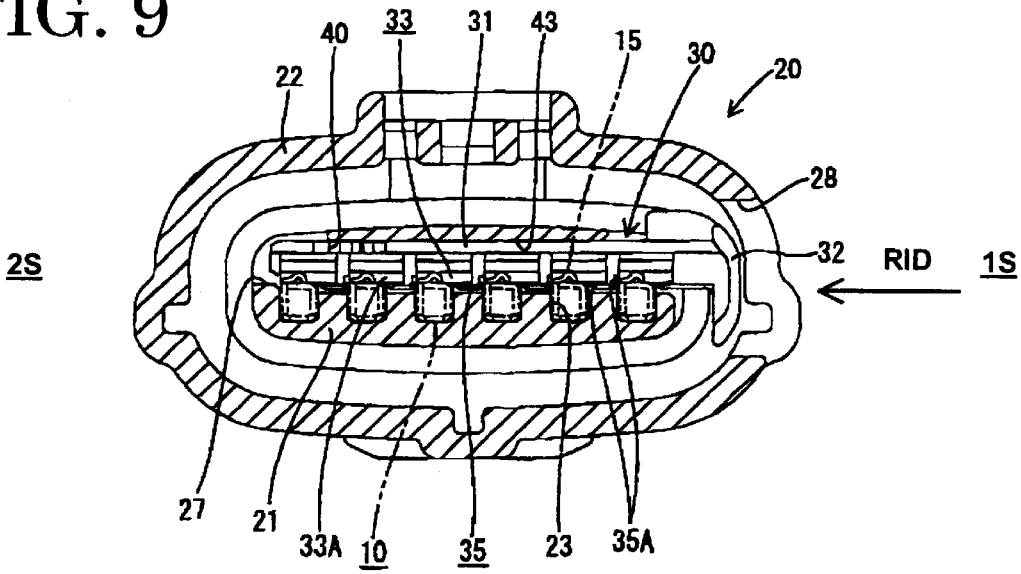
FIG. 9 is a lateral section of the connector when the retainer is located at a partial locking position.
Figure 11:
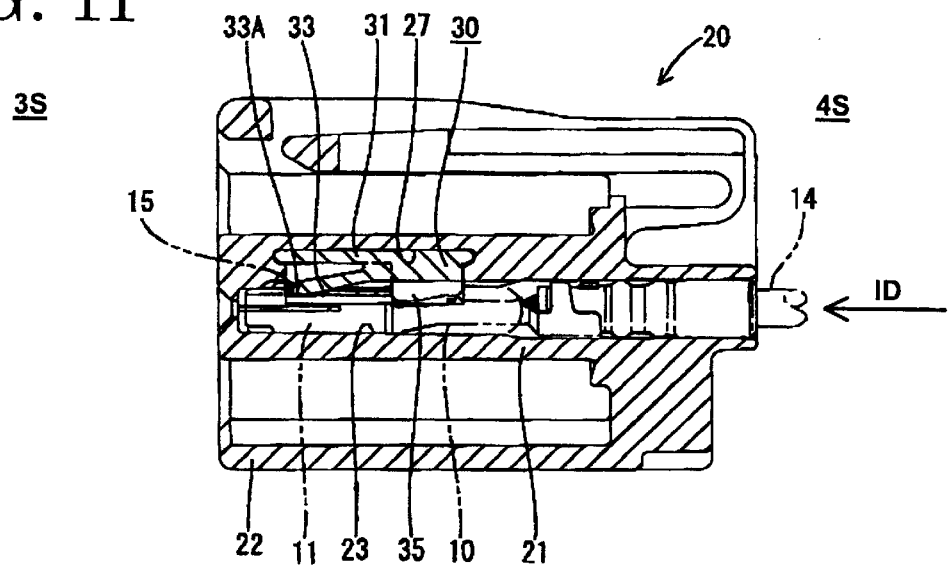
FIG. 11 is a section along 11—11 of FIG. 10.

The terminal fittings 10 then are inserted straight into the cavities 23 from behind along the inserting direction ID so that the engaging projections 15 slide along the grooves 24 in the ceilings of the cavities 23. Additionally, the upper corners of the connecting portions 11 toward the right side 1S slide along the guides 36 of the corresponding fixed locks 35 and the surfaces of the engaging projections 15 toward the left side 2S slide along the inner surfaces of the guide walls 34 of the resilient locks 33. The engaging projections 15 engage the resilient locks 33 at an intermediate stage of the insertion, and further pushing of the terminal fittings 10 in the inserting direction ID deforms the resilient locks 33. The resilient locks 33 are restored resiliently and engage the rear surfaces of the engaging projections 15 when the terminal fittings 10 reach their proper positions against the front walls of the cavities 23, as shown in FIGS. 9 to 11.

A finger or jig is inserted through the aperture 28 to push the operable portion 32 after all terminal fittings have been inserted. Thus, the retainer 30 moves in the inserting direction RID and the locking projections 44 disengage from the partial locking recesses 40. The retainer 30 is pushed until the operable portion 32 contacts the surface of the tower 21 at the right side of the housing 20. The full locking recesses 41 then engage the locking projections 44, as shown in FIG. 13, and the retainer 30 is held at the full locking position.

Figure 12:
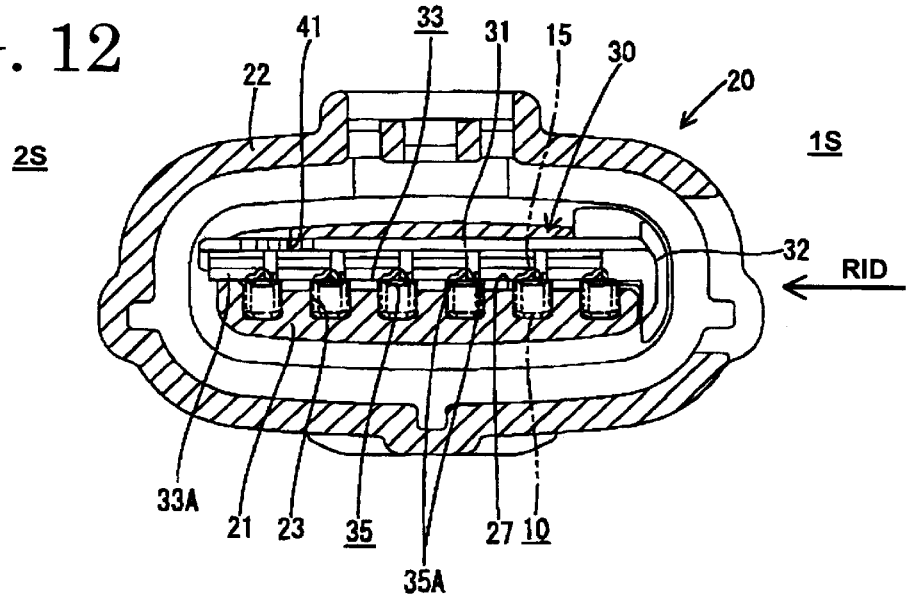
FIG. 12 is a lateral section of the connector when the retainer is located at a full locking position.

The resilient locks 33 move toward the left side 2S during the movement of the retainer 30, but remain engaged with the rear surfaces of the engaging projections 15 of the terminal fittings 10. Thus, the retainer 30 is moved smoothly. About ⅓ of each resilient lock 33 stays in the cavity 23 and engaged with the engaging projection 15 when the retainer 30 reaches the full locking position, as shown in FIGS. 11 to 13. Additionally, the fixed locks 35 project into the cavities 23 to engage the rear surfaces of the engaging steps 16 of the terminal fittings 10 over substantially their entire widths. Thus, the terminal fittings 10 are locked doubly, and locking forces are enhanced.

The terminal fittings 10 may be withdrawn for maintenance or another reason. In this situation, the retainer 30 is returned to the partial locking position by a jig. A jig then is inserted through a jig insertion hole (not shown) formed at the upper right side of each terminal insertion opening 25 in the front wall of the tower 21. The jig is slipped under the edge at the right side 1S of the resilient lock 33 to deform the resilient lock 33 and to disengage the resilient lock 33 from the engaging projection 15 of the terminal fitting 10. The terminal fitting 10 then is pulled opposite to the inserting direction ID and is withdrawn from the cavity 23.

Each resilient lock 33 continues to engage only one corresponding terminal fitting 10 while the retainer 30 is moved from the partial locking position to the full locking position. Therefore, the width thereof can be small.

The resilient locks 33 and the fixed locks 35 are spaced apart along an offset direction OD arranged at an angle, and preferably substantially a right angle to the retainer insertion direction RID. Thus, the width of the fixed locks 35 can be set independently of the width of the resilient locks 33, and can be substantially equal to the entire width of the connecting portions 11 of the terminal fittings 10 without changing the dimension of the retainer 30 along its inserting direction RID. Thus, the locking forces can be enhanced considerably. In other words, the locking forces of the fixed locks 35 can be enhanced while a space-saving purpose is fulfilled.

The separation of the resilient locks 33 from the fixed locks 35 contributes significantly to the large locking forces.

A leading edge 33A of each resilient lock 33 is gradually slanted back from its left end toward its right end when viewed from front. The slanted leading edges 33A avoid an undesired interaction with the terminal fittings 10. Thus, the engaging projections 15 of the terminal fittings 10 are guided by the slanted leading edges 33A to escape forward as the retainer is moved. A portion of each resilient lock 33 toward the left side 2S has a slightly thicker base end that functions as a guide wall 34.

Each fixed lock 35 is formed at the back of the lower surface of the main plate 31 and is displaced towards the right side 1S from a corresponding pair of the resiliently locks 33 for engaging the step 16 of the corresponding terminal fitting 10. The fixed lock 35 is substantially as wide as the front side of the cavity 23, as shown in FIG. 13.

Bevels 35A are formed at the left and right lateral corners of the leading edge of each fixed lock 35. The bevels 35A form second slanted surfaces for preventing the leading edges of the fixed lock 35 from being caught by the engaging steps 16 of the terminal fitting 10. The bevels 35A at the comers of the leading edges of the fixed locks 35 enable the fixed locks 35 to be moved to engage the rear surfaces of the engaging steps 16 without their leading edges getting caught. A guide 36 is formed by recessing the left side of the fixed lock 35 when viewed from front.

The right ends of the leading edges 33A of the resilient locks 33 are behind the widthwise centers of the engaging projections 15, when the retainer is at the full locking position, as shown in FIG. 13. Thus, the right ends of the leading edges 33A of the resilient locks 33 may get caught by the right bases 15A (see FIG. 3) of the engaging projections 15 from inside when the retainer 30 is moved in a direction opposite to the insertion direction RID and toward the partial locking position. However, the leading edges 33A of the resilient locks 33 slant gradually back toward their right ends when viewed from the front. Thus, sections of the leading edges 33A that project more forward than their right ends contact the left bases of the engaging projections 15 even if the terminal fittings 10 are moved in a direction opposite to the insertion direction ID. Accordingly, the terminal fittings 10 can escape forward of the engaging projections 15 and are guided by the slanted leading edges 33A as the retainer 30 is moved toward the partial locking position. Thus, the right bases 15A of the engaging projections 15 can escape forward, and the right ends of the leading edges 33A of the resilient locks 33 will not get caught. Therefore, the retainer 30 can be returned smoothly to the partial locking position.

Further, the bevels 35A at the corners of the leading edges of the fixed locks 35, enable the fixed locks 35 to be moved smoothly to the rear surfaces of the engaging steps 16 of the terminal fittings 10 without the leading edges thereof getting caught when the retainer 30 is moved from the partial locking position to the full locking position.

A second embodiment of the invention is described with reference to FIGS. 15 to 19. The shape of the retainer is changed in the second embodiment. The following description will be centered on differences between the first and second embodiments, and no repetitive description is given by properly identifying elements having the same or similar functions as those of the previous embodiment by the same reference numerals.

The retainer 50 of the second embodiment has a main plate 51 that is short in a direction substantially normal to the retainer insertion direction RID and hence along the longitudinal direction of the connector. Resilient locks 53 and fixed locks 55 are arrayed alternately substantially side-by-side on the rear surface of the main plate 51 and are both engageable with the engaging steps 16 of the female terminal fittings 10.

Leading edges 53A of the resilient locks 53 along the retainer insertion direction RID are widened, such that the left sides, when viewed from front, bulge out and are slanted gradually back from the left side 2S toward the right side so as to become narrower towards the back side when seen in the retainer insertion direction RID.

The leading edges of the fixed locks 55 are narrowed by having the right ends or corners cut off so as to escape the bulged-out sections of the resilient locks 53, and bevels 55A are formed at the left and right ends thereof. The bevels 55A form escaping slanted surfaces of the second locks for avoiding an undesired interaction with the respective terminal fitting 10.

Figure 18:
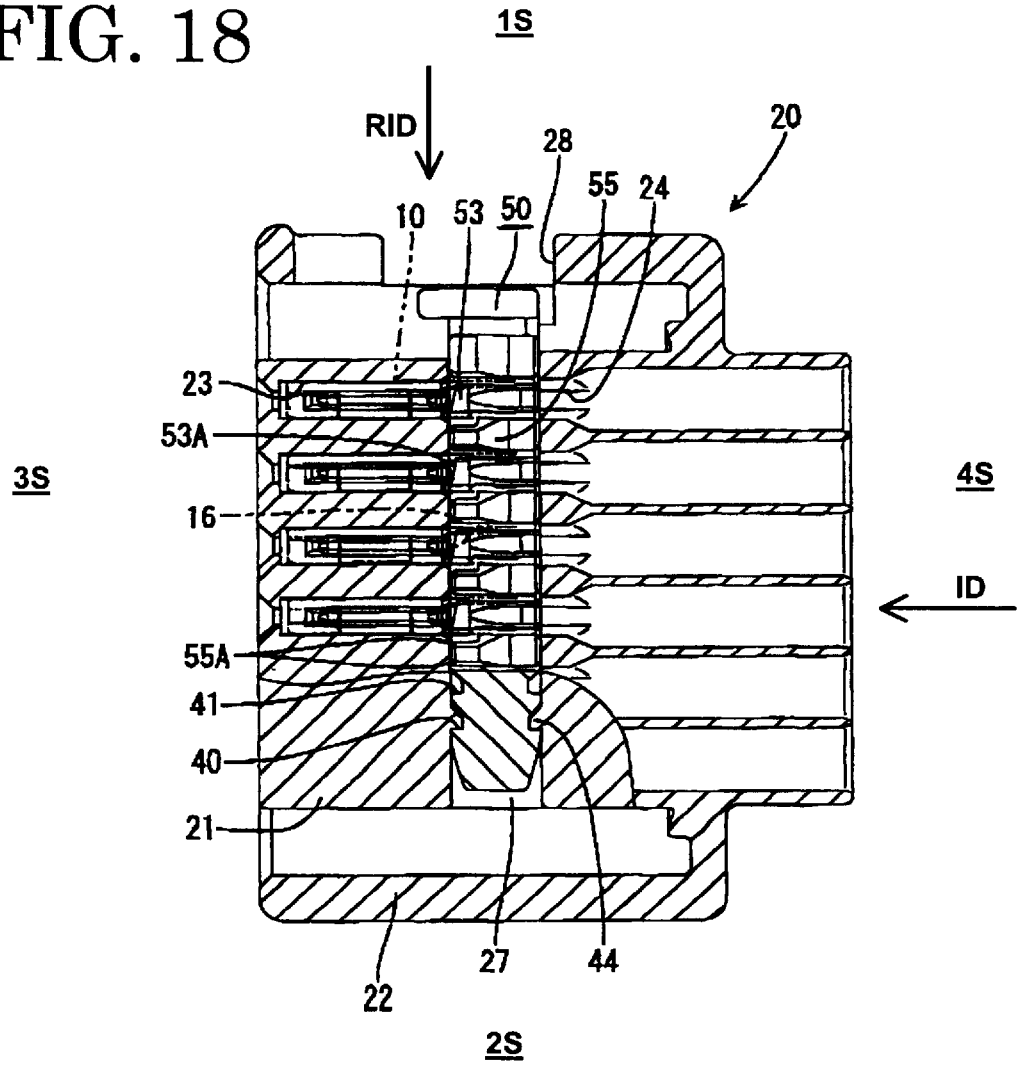
FIG. 18 is a section of the connector viewed from below when the retainer is located at a partial locking position.

As shown in FIG. 18, the retainer 50 is at a partial locking position when the locking projections 44 engage the partial locking recesses 40 at the front side of the retainer 50 with respect to the inserting direction RID. At this partial locking position, the resilient locks 53 project into the corresponding cavities 23 over the entire widths thereof, whereas the fixed locks 55 are retracted towards the right side 1 S from the corresponding cavities 23 when viewed from front.

Figure 19:
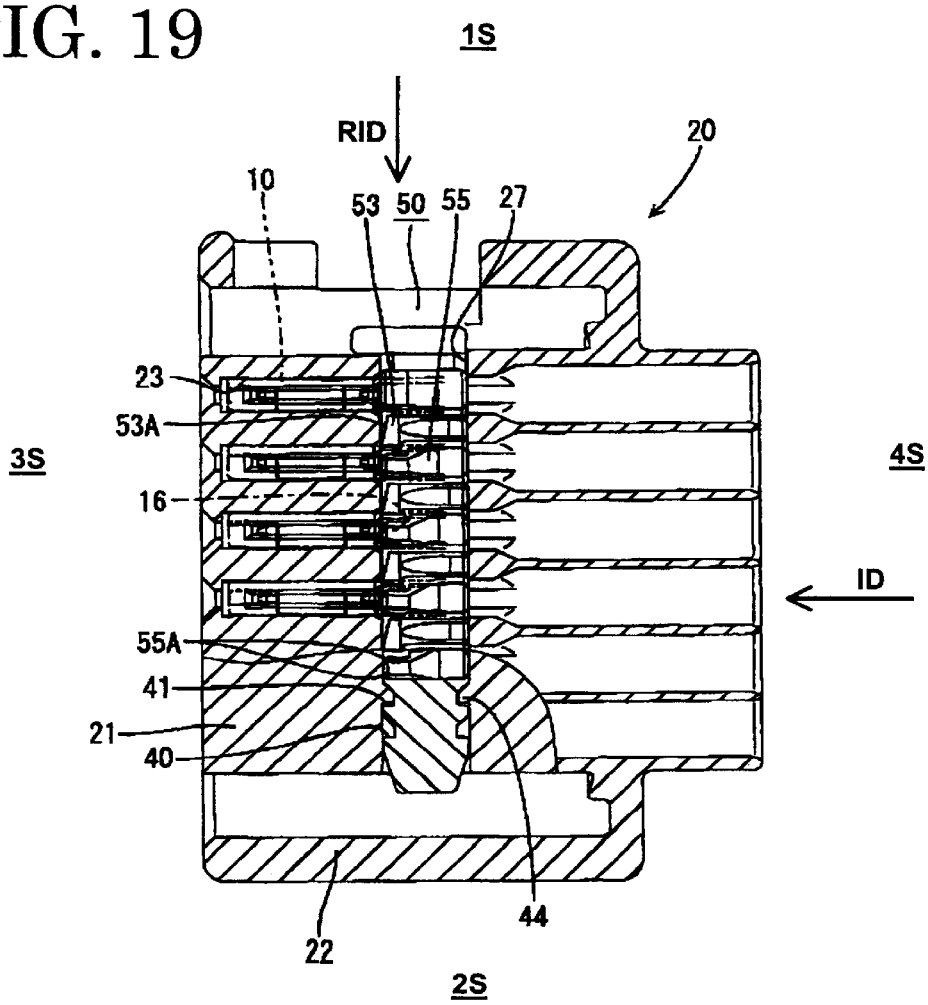
FIG. 19 is a section of the connector viewed from below when the retainer is located at a full locking position.

The retainer 50 is at the full locking position when the locking projections 44 engage the full locking recesses 41 behind the partial locking recesses 40 with respect to the inserting direction RID of the retainer 50, as shown in FIG. 19. At this full locking position, the fixed locks 55 project into the corresponding cavities 23 at positions displaced towards the left side 2S. The resilient locks 53 exit towards the left side 2S from the corresponding cavities 23. However, the bulged-out sections at the left ends of the leading edges 53A project up to positions in the cavities 23 at their left sides slightly inside the right side surfaces of the cavities 23.

The retainer 50 of the second embodiment initially is held at the partial locking position, as shown in FIG. 18. In this partial locking position, the resilient locks 53 project into the corresponding cavities 23 and the fixed locks 55 are retracted in a direction opposite the retainer insertion direction RID. The terminal fittings 10 then are inserted into the corresponding cavities 23 and resiliently deform the resiliently locks 53. The resilient locks 53 are restored resiliently to engage the rear surfaces of the engaging steps 16 when the terminal fittings 10 are pushed to their proper positions.

The retainer 50 is pushed in the retainer insertion direction RID to the full locking position, as shown in FIG. 19, upon completion of the insertion of the female terminal fittings 10. Then, the fixed locks 55 project into the cavities 23 instead of the resilient locks 53 to engage the rear surfaces of the engaging steps 16 of the terminal fittings 10 at positions displaced toward the left side 2S. At this time, the fixed locks 55 can be moved to the rear surfaces of the engaging steps 16 without the leading edges thereof getting caught due to the bevels 55A at the left corners of the leading edges of the fixed locks 55.

Further, the bulged-out left ends of the leading edges 53A of the moved resilient locks 53 engage the right ends of the engaging steps 16 of the terminal fittings 10 in the cavities 23 at the left sides of the resilient locks 53, with the result that the terminal fittings 10 are locked doubly.

To withdraw the terminal fittings 10, the retainer 50 is returned from the full locking position to the partial locking position in a direction opposite to the retainer insertion direction RID. When the retainer 50 is at the full locking position, the right ends of the leading edges 53A of the resilient locks 53 toward the right side 1S are retracted from the corresponding cavities 23, as shown in FIG. 19. Thus, when the retainer 50 and the resilient locks 53 are moved toward the right side 1S and into the partial locking position, the resilient locks 53 may get caught from the outside by the left edges of the engaging steps 16 of the female terminal fittings 10 and further from inside by the right edges thereof. However, the leading edges 53A of the resilient locks 53 slant gradually back toward the right side 1S. Thus, the leading edges 53A are prevented from getting caught from the outside by the left edges of the engaging steps 16 at an initial stage of the movement of the retainer 50 because the right ends thereof are located more backward. The terminal fittings 10 may be moved towards the back side 4S while the retainer 50 is being moved. However, the sections of the leading edges 53A that project more forward than their right ends contact the left edges of the engaging steps 16, and the female terminal fittings 10 can be guided by the oblique leading edges 53A and can escape forward via the engaging steps 16. Thus, the right edges of the engaging steps 16 are allowed to escape forward while the retainer 50 is moved toward the partial locking position, and the right ends of the leading ends 53A of the resilient locks 53 are prevented from getting caught.

Further, the bevels 55A also are formed at the right corners of the leading edges of the fixed locks 55. Therefore, the fixed locks 55 can be moved to their retracted positions without getting caught by the right edges of the engaging steps 16 from inside, and the retainer 50 can be moved smoothly between the partial locking position and the full locking position.

The invention is not limited to the above described and illustrated embodiments. For example, the following embodiments also are embraced by the technical scope of the invention as defined in the claims. Beside the following embodiments, various changes can be made without departing from the scope and spirit of the present invention as defined in the claims.

Although the resilient locks 33 and the fixed locks 35 are displaced in forward and backward directions in the foregoing embodiment, they may be arrayed substantially side-by-side in a transverse direction.

The present invention is also applicable to male connectors or nonwatertight connectors.

Figure 20:
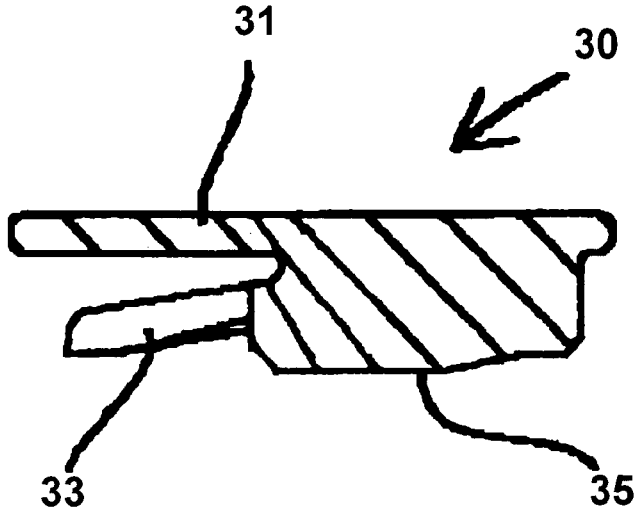
FIGS. 20 is a section of a retainer according to a further preferred embodiment of the invention.
Figure 21A:
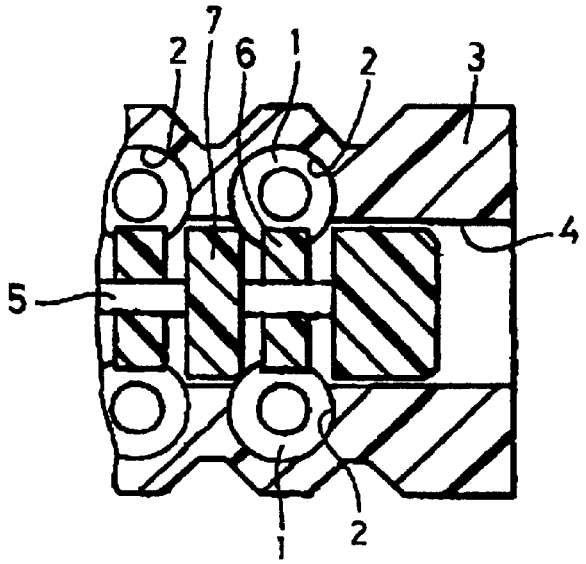
FIG. 21A PRIOR ART
FIGS. 21A and 21B are fragmentary sections of a prior art connector.
Figure 21B:
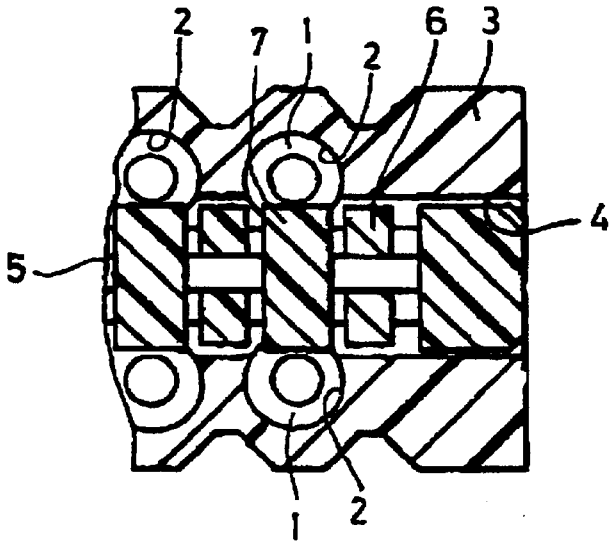
FIG. 21B PRIOR ART
Figure 22:
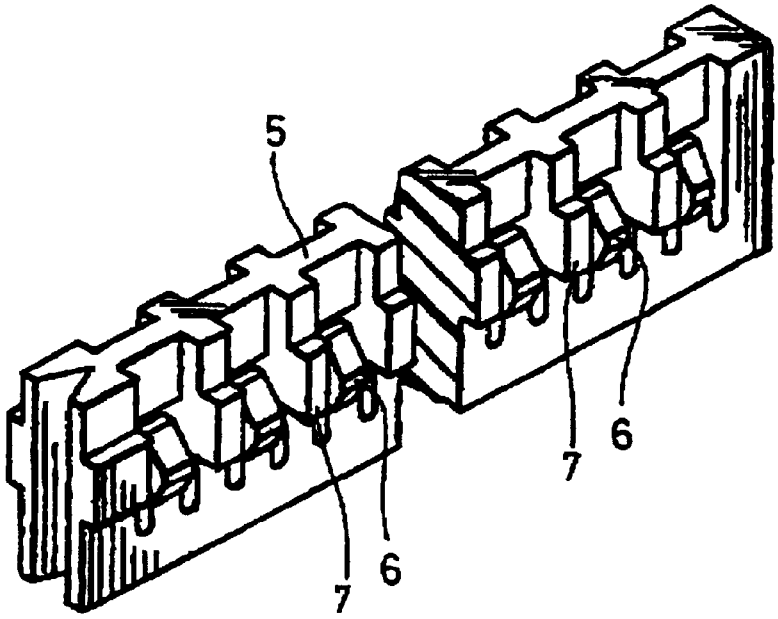
FIG. 22 PRIOR ART
FIG. 22 is a perspective view of a retainer of the prior art connector.
Figure 23A:
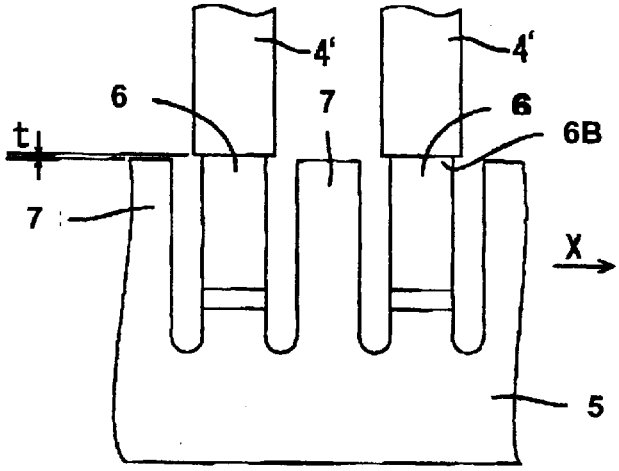
FIG. 23A PRIOR ART
FIGS. 23A and 23B are fragmentary diagrams showing how the prior art connector acts.
Figure 23B:
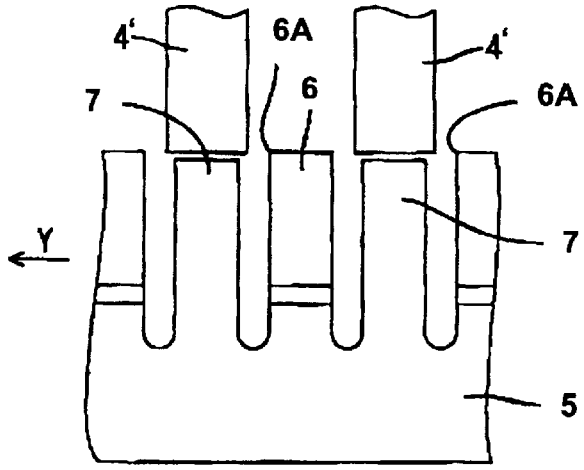
FIG. 23B PRIOR ART

The fixed locks shown in the foregoing embodiments may be located more forward so as to overlap, for example, the base ends of the resilient locks. This enables a dimension of the retainer in a direction normal to the inserting direction to be smaller. As shown in FIG. 20, the retainer 30 may be formed such that the second locks are movably provided by being coupled to or provided on deformable sections of the corresponding first locks.

The resilient locks can be located within the width range of the terminal fittings at the locking position while being completely spaced apart sideways from the terminal fittings at the retracted position. However, the engaging portions of the terminal fittings may catch the resilient locks while the retainer is moved between the partial locking position and the full locking position. Such an undesirable event can be avoided by beveling the left and right corners of the leading edges of the resilient locks similar to the fixed locks.

What is claimed is:

1. A connector comprising a housing formed with cavities into which terminal fittings are at least partly insertable, a retainer insertion opening fanned in a first side surface of the housing and crossing the respective cavities, and a retainer insertable into the retainer insertion opening and being alternately held at a partial locking position and at a full locking position, the retainer comprising resiliently deformable first locks that resiliently deform to permit insertion of the terminal fittings into the respective cavities and that resiliently return toward an undeformed condition to engage and lock the terminal fittings that have been inserted properly when the retainer is at the partial locking position, and second locks for locking the properly inserted terminal fittings when the retainer is at the full locking position, and wherein the first locks of the retainer continue to engage only the corresponding terminal fittings while the retainer is moved from the partial locking position to the full locking position, and after the retainer is in the full locking position.

2. The connector of claim 1, wherein the first and second locks of the retainer are spaced apart in an offset direction substantially normal to an inserting direction of the retainer.

3. The connector of claim 2, wherein escaping slanted surfaces are formed at corners of locking edges of the first locks of the retainer for locking the terminal fittings.

4. The connector of claim 1, wherein at least one the first locks and the second locks comprise guides for guiding insertion of the terminal fitting.

5. The connector of claim 1, wherein each first lock is wider than the cavity at the retainer insertion opening.

6. The connector of claim 1, wherein the second locks are fixed at positions spaced from deformable sections of the first locks.

7. The connector of claim 6, wherein each said second lock is coupled to a deformable section of the corresponding first lock.

8. The connector of claim 1, wherein the second locks partly overlap with the first locks along the offset direction.

9. The connector of claim 1, wherein each first lock of the retainer is wider than the terminal fitting, so that the first lock locks the terminal fitting with opposite lateral sides thereof located outside the opposite side surfaces of the terminal fitting when the retainer is at the partial locking position and only one lateral side of each first lack locks the terminal fitting when the retainer is at the full locking position.

10. The connector of claim 1, wherein each of the first locks has a locking edge that is slanted back from the second lateral side toward the first lateral side of the retainer.

11. The connector of claim 10, wherein the slanted surfaces are beveled.

12. The connector of claim 11, wherein the terminal fittings are doubly locked in the cavities by the first locks and the second locks, when the retainer is in the full locking position.

13. A connector, comprising:

a housing formed with cavities into which terminal fittings are at least partly insertable, a retainer insertion opening formed in a first side surface of the housing and crossing the respective cavities, and a retainer insertable into the retainer insertion opening and being alternately held at a partial locking position and at a full locking position, the retainer comprising resiliently deformable first locks that resiliently deform to permit insertion of the terminal fittings into the respective cavities and that resiliently return toward an undeformed condition to engage and lock the terminal fittings that have been inserted properly when the retainer is at the partial locking position, and second locks for locking the properly inserted terminal fittings when the retainer is at the full locking position, wherein the first and second locks of the retainer are spaced apart in an offset direction substantially normal to an inserting direction of the retainer.

14. The connector of claim 13, wherein each first lock is wider than the cavity at the retainer insertion opening.

15. The connector of claim 13, wherein the second locks are fixed at positions spaced from deformable sections of the first locks.

16. The connector of claim 13, wherein each first lock of the retainer is wider than the terminal fitting, so that the first lock locks the terminal fitting with opposite lateral sides thereof located outside the opposite side surfaces of the terminal fitting when the retainer is at the partial locking position and only one lateral side of each first lock locks the terminal fitting when the retainer is at the full locking position.

17. A connector, comprising:

a housing formed with cavities into which terminal fittings are at least partly insertable, a retainer insertion opening formed in a first side surface of the housing and crossing the respective cavities, and a retainer insertable into the retainer insertion opening and being alternately held at a partial locking position and at a full locking position, the retainer comprising resiliently deformable first locks that resiliently deform to permit insertion of the terminal fittings into the respective cavities and that resiliently return toward an undeformed condition to engage and lock the terminal fittings that have been inserted properly when the retainer is at the partial locking position, and second locks for locking the properly inserted terminal fittings when the retainer is at the full locking position, and wherein escaping slanted surfaces are formed at corners of locking edges of the first locks of the retainer for locking the terminal fittings.

18. The connector of claim 17, wherein each first lock is wider than the cavity at the retainer insertion opening.

19. The connector of claim 17, wherein the second locks are fixed at positions spaced from deformable sections of the first locks.

* * * * *